US008137744B2

(12) United States Patent
Lu

(10) Patent No.: US 8,137,744 B2
(45) Date of Patent: Mar. 20, 2012

(54) WATER-CONTACT IDENTIFICATION LABEL AND MANUFACTURING METHOD THEREFOR

(75) Inventor: Edison Lu, Jhonghe (TW)

(73) Assignee: E&I Marketing Consultant Co., Ltd., Taipei (TW)

( * ) Notice: Subject to any disclaimer, the term of this patent is extended or adjusted under 35 U.S.C. 154(b) by 241 days.

(21) Appl. No.: 12/431,775

(22) Filed: Apr. 29, 2009

(65) Prior Publication Data

US 2009/0205775 A1 Aug. 20, 2009

Related U.S. Application Data

(62) Division of application No. 11/675,099, filed on Feb. 15, 2007.

(51) Int. Cl.
*B05D 5/10* (2006.01)

(52) U.S. Cl. ..... 427/207.1; 428/68; 428/343; 428/349; 428/351; 428/354; 252/188.1; 252/188.28

(58) Field of Classification Search ..... 427/207.1; 428/68, 343, 349, 351, 354; 252/188.1, 188.28
See application file for complete search history.

(56) References Cited

U.S. PATENT DOCUMENTS

| | | | | |
|---|---|---|---|---|
| 5,460,874 | A * | 10/1995 | Rao | 428/32.23 |
| 2002/0061595 | A1 * | 5/2002 | Yabuki et al. | 436/39 |
| 2003/0096107 | A1 * | 5/2003 | Birkholz et al. | 428/343 |
| 2006/0002816 | A1 * | 1/2006 | Zimmer et al. | 422/56 |

* cited by examiner

*Primary Examiner* — Michael Cleveland
*Assistant Examiner* — Xiao Zhao
(74) *Attorney, Agent, or Firm* — Leong C. Lei

(57) ABSTRACT

An identification label changes color in an irreversible manner once put into contact with water/humidity. The label has a water-absorbable paper-based substrate having a surface on which an ink zone formed by printing of water-repellent or hydrophobic ink thereon and an opposite second surface on which a coating layer is formed. The ink zone has a color substantially identical to color of the substrate. The coating layer contains water soluble substance, which dissolves into water to form a solution that, once being absorbed by the substrate, changes the color of the substrate, the color of the solution being different from that of the substrate. A layer of adhesive is formed below the coating layer. Alternatively, the coating layer is formed on a surface of a double-sided adhesive layer and is bonded to a surface of the substrate opposite to the surface on which the ink zone is formed.

7 Claims, 3 Drawing Sheets

WATER-CONTACT IDENTIFICATION LABEL AND MANUFACTURING METHOD THEREFOR

CROSS-REFERENCE TO RELATED APPLICATION

This is a division of pending patent application Ser. No. 11/675,099, filed Feb. 15, 2007.

BACKGROUND OF THE INVENTION

1. Field of the Invention

The present invention relates to an identification label and a manufacturing method therefor, and in particular to an identification label that identifies if a product carrying the label has been put in contact with water/humidity and a manufacturing method therefor.

2. The Related Arts

In the modern society, the relationship between a seller of a product and a buyer is not just one selling and one buying. After service and maintenance of the product sold are also obligations of the seller/manufacturer. A lot of merchandises, such as electronic products, electrical devices, and mechanical devices, are nowadays subject to quality guarantee, which includes a given period of free maintenance. Such a free maintenance entitles the purchasers maintenance and repairing of flaw products and/or parts without charge to the purchasers. This ensures that the general consumers may always obtain products of acceptable quality for operation of at least an acceptable period of time without failure, or replacement will be done.

Although the buyer is entitled free maintenance/repairing or even replacement of flow or malfunctioning products, such a privilege is subject to limitation that the buyer is not using the products in a malignantly or damaging the product on purpose. However, it is often difficult to identify if the failure of a product is caused by malignant use or by inherent flaws and disputes regarding responsibility may be resulted.

Taking electronic products as an example, such as a mobile phone, the mobile phone is carried by a user and due to being small in size, the mobile phone is easy to drop into for example water and thereby damaged. The water penetrating into the mobile phone or electronic device may be vaporized, leaving no evidence of how the device is damaged. The manufacturer often has to take the responsibility of free maintenance/repairing of the device for such a situation and this causes the manufacturers significant economic loss.

On the other hand, the global weather is getting worse year by year and accidental floods often occur all over the world. The flood is sometimes caused by very heavy rain in a short period. This often prevents people to move their stuffs to high altitude timely so that their properties are often flooded and undesirably soaked in water. These properties, such as electronic devices or automobiles, once being soaked in water, are easy to recover outside appearance thereof after being dried. However, proper functioning is not always guaranteed for those flooded devices. This flooded device may be sold malignantly without disclosing the fact of being flooded. This certainly causes economic loss of the buyers of the potentially-malfunctioning flooded devices.

SUMMARY OF THE INVENTION

Thus, the present invention is aimed to provide an identification label that changes color when put into contact with water/humidity, as well as a manufacturing method therefor, wherein a water soluble coating is provided on the label, which causes color change of the label, to identify if a product carrying the label has been put into contact with water/humidity so as to help resolve dispute between seller and buyer and to allow a buyer to identify if the product is a flooded device.

The present invention can be embodied in a variety of forms, including labels and stickers, or is alternatively directly printed on a surface or an internal part of a product whereby when the product is put into contact with water, color change or showing up of pattern or text on the label. The label does not resume the original color even when the label is dried by the evaporation of the water that wets the label. Thus, an indication can be provided, which clearly illustrates if the product is subject to flooding or wetting by color change or appearance of the identification pattern or text. Most of the inks that are printed on paper or other substrate are comprised of water-repellent or hydrophobic substance, while a substrate made of paper based material is easy to absorb water or humidity. Also, a variety of coating materials available in the market are comprised of water soluble substance. By combination of these substances/components, an irreversible color change can be made on a label when the label is put into contact with water, as well as a method for manufacturing the label, and such a label and a method for manufacturing such a label are provided. The label can be embodied in other forms, such as a sticker, or alternatively directly printing on a product can be applied. In accordance with the present invention, a substrate, which is made of a paper based material that is of high water absorbability, is provided, having a first surface on which ink that is hydrophobic or water repellent is printed to form an ink zone and an opposite second surface on which a coating layer is formed, wherein the ink zone has a color substantially identical to color of the substrate; the coating layer is comprised of a water soluble substance and once a solution formed by dissolving the substance of the coating layer into water is absorbed by the substrate, the color of the substrate is changed, the color of the solution formed by dissolving the coating layer into water being different from that of the substrate. If desired, a layer of adhesive is provided below the coating layer. In an alternative embodiment, the coating layer is formed on one surface of a double-sided adhesive tape, and is bonded to a surface of the substrate that is opposite to the surface on which the ink zone is formed.

BRIEF DESCRIPTION OF THE DRAWINGS

The present invention will be apparent to those skilled in the art by reading the following description of preferred embodiments thereof and the best modes for carrying out the present invention, reference being had to the attached drawings, wherein.

DETAILED DESCRIPTION OF THE PREFERRED EMBODIMENTS

The present invention provides a label for identifying if a product carrying such a label has been put in contact with water or humidity and a method for manufacturing the label. The present invention can be embodied in a variety of sheet-like forms, such as a piece of paper, and is preferably in the form of a stick or a label. Alternatively, the present invention can be embodied by being directly printed on a product for identification if the product has been put in contact with water or humidity. In the following, the principle of the present invention will be described with reference to the attached drawings.

Figure 1:
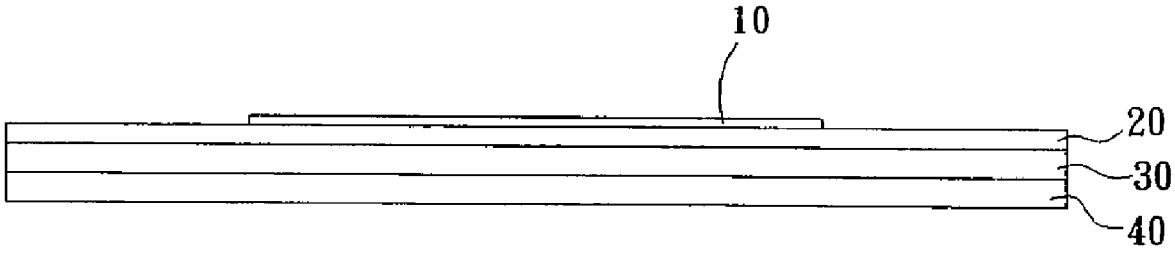
FIG. 1 is a side elevational view of a water-contact identification label constructed in accordance with a preferred embodiment of the present invention.

Referring to FIG. 1, which illustrates a side elevational view of a label constructed n accordance with the present invention, the label is formed with a piece of paper 20, serving as a substrate having a first surface on which an ink zone 10 is formed by printing ink on the first surface and an opposite second surface on which a coating layer 30 is applied. The ink that forms the ink zone 10 has a color substantially identical to the color of the paper substrate 20 whereby the ink zone 10 is visually unidentifiable. The ink that forms the ink zone 10 is a water-repellent or hydrophobic substance and is applied to the first surface of the paper substrate 20 by direct printing. The coating layer 30 is formed with a water soluble substance and when dissolved in water and absorbed by the paper substrate 20 makes the color of the paper substrate 20 visually distinct from that of the ink zone 10. The paper substrate 20 is made of a high-water-absorbability substance and an example is simile paper. Other material, such as enamel paper, can also be used and is considered within the scope of the present invention.

The present invention is aimed to provide a label for identifying if a product has been put in contact with water or humidity, and thus one of the feasible ways to exercise the present invention is to adhesively attach the label of the present invention to the product to be inspected. Consequently, it is preferable that an adhesive layer 40 is provided under the coating layer 30 of the label described above.

When the present invention is put in contact with water or humidity, the substance of the coating layer 30 is dissolved in the water and then absorbed by and spread through the paper substrate 20 whereby the color of the substance of the coating layer 30 is retained in the paper substrate 20. The color of the coating layer 30 is made different from that of the ink zone 10 so that when the color of the coating layer 30 is absorbed by the paper substrate 20 as described above, the ink zone 10 is visually and clearly identifiable over the paper substrate 20. The ink zone 10 can bear any pattern as desired by users. For example, the label of the present invention can be made a sticker that is attached to an engine of an automobile so that when the automobile is flooded, words such as "flooded car" emerge from the sticker surface. This allows a consumer to identify if the automobile has been flooded.

Figure 2A:
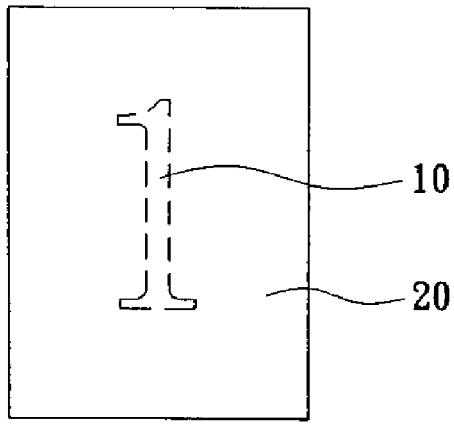
FIGS. 2A and 2B demonstrate a practical application of the identification label of the present invention, respectively showing conditions before and after the label is put into contact with water.
Figure 2B:
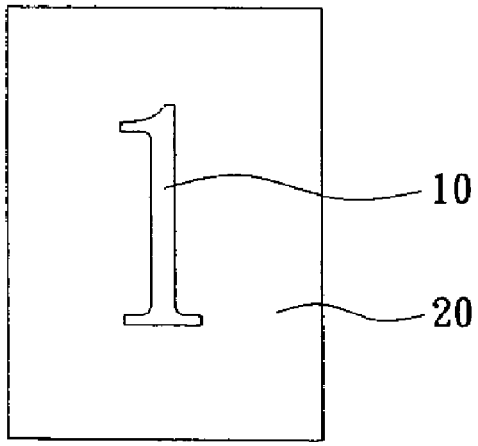

FIGS. 2A and 2B demonstrate the operation of the present invention. As shown in FIG. 2A, a paper substrate 20 has an ink zone 10 printed thereon and carrying a figure "1", which cannot be visually identified without contact with water. Once the paper substrate 20 is put into contact with water, the coating layer arranged under the paper substrate 20 dissolves in the water to form a solution that is then absorbed by the paper substrate 20, leading to change of color of the paper substrate 20 and making the ink zone emerging as shown in FIG. 2B to clearly show up the figure "1". Besides being put into contact with water, steam may also be used to initiate the color change mechanism in accordance with the present invention. By absorbing steam or vapor, the color of the coating layer may also be spread into the paper substrate 20 to make the ink zone 10 emerging.

Figure 3:
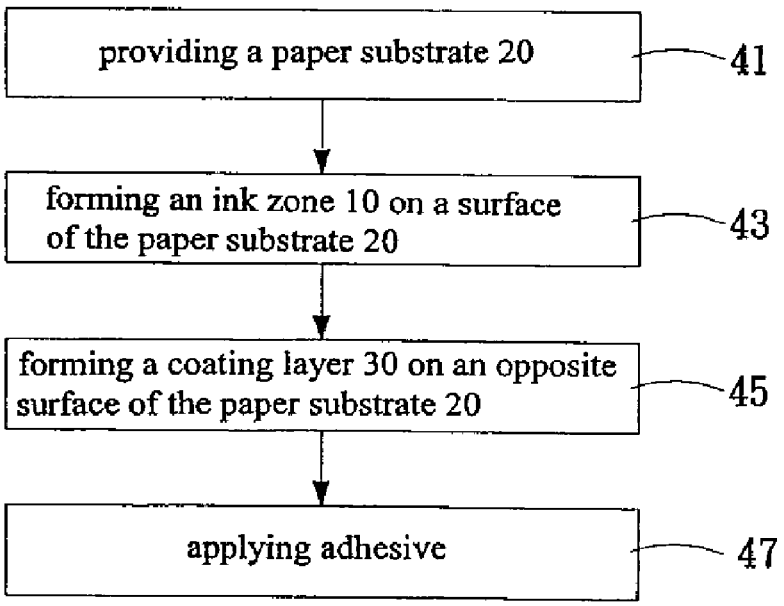
FIG. 3 is a flow chart illustrating a method for manufacturing the label in accordance with the present invention.

FIG. 3 shows a flow chart of a method for manufacturing the label of the present invention. Firstly, a piece of paper 20 is provided, as indicated in step 41, to serve as a paper substrate. The piece of paper 20 is selected from any substance of high water absorbability, such as simile paper. Next, in step 43, an ink zone 10 is printed on a first surface of the paper substrate 20. The ink zone 10 can be of any desired patterns and the ink zone 10 has a color substantially identical to the color of the paper substrate 20 and is made of a water repellent or hydrophobic material.

Next, in step 45, a coating layer 30 is formed on an opposite second surface of the paper substrate 20. The coating layer 30 is comprised of a water-soluble material, having a color that is visible or a color that is invisible, but when the coating layer 30 dissolves in water to form a solution that, after being absorbed by the paper substrate 20, changes the color of the paper substrate 20. Finally, in case that the label of the present invention is made a sticker, a layer of adhesive 40 is applied under the coating layer 30 (step 47) to suit different needs for the product.

Figure 4:
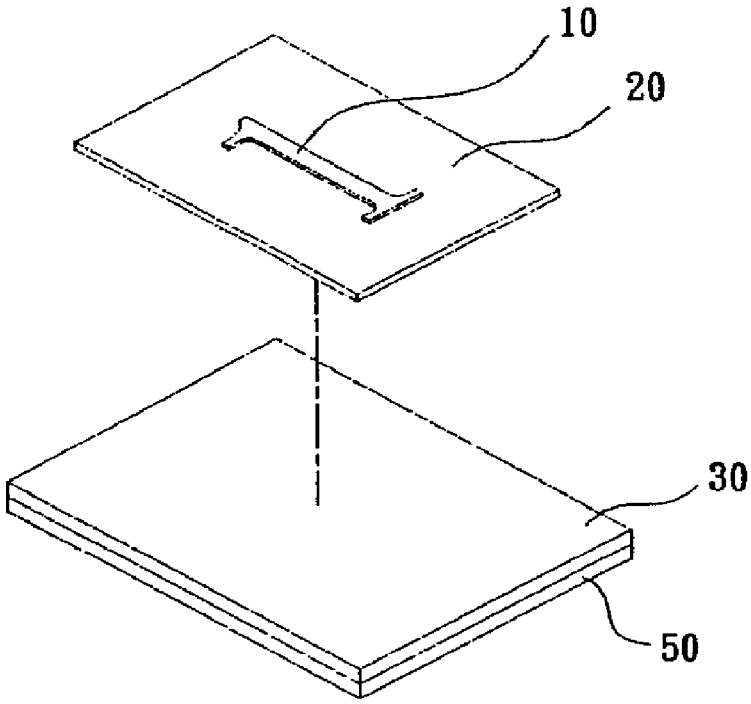
FIG. 4 is a perspective view schematically showing an identification label constructed in accordance with another embodiment of the present invention.

FIG. 4 shows a different embodiment of the present invention. The coating layer 30 can be applied to one surface of a double-sided adhesive tape 50 in advance. Then, the paper substrate 20 on which the ink zone 10 has already been formed is attached to the coating layer 30. The coating layer 30, when dissolving in water, forms a solution that is absorbed by the paper substrate 20. Preferably, the coating layer 30 is comprised of a non-volatile material so that after the paper substrate 20 is wetted by the solution of the coating layer 30, the composition or molecules of the coating layer 30 constantly remain in the paper substrate 20 even after the paper substrate 20 is dried in any way. This means the paper substrate 20, once colored by the coating layer 30, cannot resume its original color.

Figure 5:
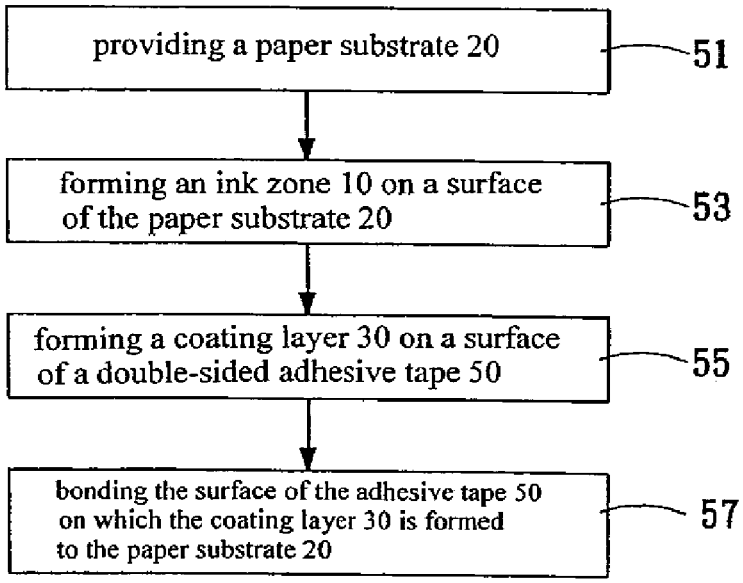
FIG. 5 is a flow chart illustrating a method for manufacturing the label in accordance with said another embodiment of the present invention.

FIG. 5 shows a flow chart of a method for manufacturing the label of the different embodiment. In step 51, a piece of paper, serving as a paper substrate 20, is provided. In step 53, a surface of the paper substrate 20 is printed with an ink zone 10. Then, a piece of a double-sided adhesive tape 50 is provided and a coating layer 30 is applied on a surface of the tape 50 in step 55. Finally, the surface of the double-sided adhesive tape 50 that carries the coating layer 30 is bonded to an opposite surface of the paper substrate 20, which completes step 57.

Although the present invention has been described with reference to the preferred embodiments and demonstrated with the best mode for carrying out it, it is apparent to those skilled in the art that a variety of modifications and changes may be made without departing from the scope of the present invention which is intended to be defined by the appended claims.

What is claimed is:

1. A method of manufacturing a label that changes color when put into contact with water, comprising steps of:

(a) providing a substrate which is made of a water absorbing substance, said substrate comprising a piece of paper selected from a group consisting of at least simile paper and enamel paper;

(b) forming an ink zone on a first surface of said substrate, said ink zone having a color that is identical to color of said substrate and made of a hydrophobic substance, said ink zone being smaller than said substrate in size and shaped into desired words or patterns; and (c) forming a coating layer on an opposite surface of said substrate, said coating layer being comprised of a water-soluble material that is different from said ink zone in color;

wherein when said label is in contact with water, said water-soluble material of said coating layer is dissolved in said water and then absorbed by and retained in said substrate thereby making said ink zone visually identifiable over said substrate.

2. The method as claimed in claim 1, further comprising a step of forming a layer of adhesive under said coating layer.

3. The method as claimed in claim 1, wherein said ink zone is formed on said substrate by printing.

4. The method as claimed in claim 1, wherein said coating layer is visible in color.

5. A method of manufacturing a label that changes color when put into contact with water, comprising steps of:

(a) providing a substrate which is made of a water absorbing substance, said substrate comprising a piece of paper selected from a group consisting of at least simile paper and enamel paper;

(b) forming an ink zone on a first surface of said substrate, said ink zone having a color that is identical to color of said substrate and made of a hydrophobic substance, said ink zone being smaller than said substrate in size and shaped into desired words or patterns; and (c) forming a coating layer on an opposite surface of said substrate, said coating layer being comprised of a water-soluble material that is different from said ink zone in color, a piece of double-sided adhesive tape being bonded to said coating layer;

wherein when said label is in contact with water, said water-soluble material of said coating layer is dissolved in said water and then absorbed by and retained in said substrate thereby making said ink zone visually identifiable over said substrate.

6. The method as claimed in claim 5, wherein said ink zone is formed on said substrate by printing.

7. The method as claimed in claim 5, wherein said coating layer is visible in color.

* * * * *